US005927616A

United States Patent [19]

Grise et al.

[11] Patent Number: 5,927,616

[45] Date of Patent: Jul. 27, 1999

[54] QUICK CHANGE RINSE ARM FOR WAREWASHER

[75] Inventors: Ronald Eugene Grise, Piqua; William David Schrand, Oregonia, both of Ohio

[73] Assignee: Premark FEG L.L.C., Wilmington, Del.

[21] Appl. No.: 08/923,704

[22] Filed: Sep. 4, 1997

[51] Int. Cl.[6] ..... B05B 1/20

[52] U.S. Cl. ..... 239/600; 239/566; 134/201

[58] Field of Search ..... 239/600, 566; 134/201

[56] References Cited

U.S. PATENT DOCUMENTS

| | | | |
|---|---|---|---|
| Re. 30,537 | 3/1981 | Fraula et al. | 134/10 |
| 2,063,746 | 11/1936 | Meeker | 141/9 |
| 2,073,521 | 3/1937 | Johnston et al. | 141/9 |
| 2,128,008 | 8/1938 | Meeker | 141/9 |
| 2,158,904 | 5/1939 | Meeker et al. | 15/76 |
| 2,217,705 | 10/1940 | Rataiczak et al. | 141/0 |
| 2,229,663 | 1/1941 | Meeker et al. | 141/9 |
| 2,707,961 | 5/1955 | Geiger et al. | 134/58 |
| 2,947,311 | 8/1960 | Fox et al. | 134/58 |
| 3,049,391 | 8/1962 | Meeker et al. . | |
| 3,141,618 | 7/1964 | Haas | 239/566 |
| 3,706,317 | 12/1972 | Fox et al. | 134/57 |
| 4,018,239 | 4/1977 | Caldwell et al. | 134/143 |
| 4,187,122 | 2/1980 | Query | 134/95 |
| 4,257,559 | 3/1981 | Noren | 239/283 |
| 4,439,242 | 3/1984 | Hadden | 134/25.2 |
| 4,657,188 | 4/1987 | Crane et al. | 239/557 |
| 5,383,486 | 1/1995 | Warner et al. | 137/15 |

*Primary Examiner*—Andres Kashnikow
*Assistant Examiner*—David Deal
*Attorney, Agent, or Firm*—Thompson Hine & Flory LLP

[57] ABSTRACT

A rinse arm spray system for directing multiple streams of water supplied under pressure from a source of water, the system comprising: a water supply conduit for supplying the water; a rinse arm having an exterior surface, an interior volume, a first open end, and a second end, the arm being releasably connected to the water supply conduit wherein the first open end is in communication with the water supply conduit; a plurality of spray nozzles spaced apart along the exterior surface of the arm, the nozzles communicating with the interior volume of the arm for providing directed streams of water supplied to the arm under pressure; an actuating mechanism releasably connected to a second end of the rinse arm, the actuating mechanism comprising a rod adapted to cooperate with the second end of the rinse arm, a guide tube for supporting the rod, a helical spring enclosing the rod, and a pressure actuating means for exerting pressure to compress the spring wherein the rinse arm is disengaged from the system, and for releasing pressure to relax the spring wherein the rinse arm is securely engaged in the system.

5 Claims, 3 Drawing Sheets

QUICK CHANGE RINSE ARM FOR WAREWASHER

SUMMARY OF THE INVENTION

This invention relates to a wearwashing machine, and particularly relates to a rinse arm mechanism which provides quick release of the arm so that it can be easily removed for cleaning or replacing.

BACKGROUND OF THE INVENTION

Dishwashing machines fall into two generally distinct but somewhat overlapping categories, namely, domestic or home machines, and commercial machines such as are used in restaurants, institutions or other public facilities. This latter category is itself divisible into various types of commercial machines.

Two of the most common types of commercial machines are the single rack-type and the conveyor-type. The former includes a single chamber into which a rack of soiled ware can be placed. Within the chamber, the entire cleaning process including washing, rinsing and drying is performed on the rack. Multiple racks must be washed sequentially, with each rack being completely cleaned before the next can be operated upon.

Conveyor-type machines, on the other hand, include a conveyor for carrying racks of ware through multiple stations within the machine. A different operation is carried out at each station, such as washing, rinsing, or drying. Thus, multiple racks of ware can be placed on the conveyor and moved continuously through the machine so that, for example, while one rack is being rinsed, a succeeding rack can be dried.

Examples of both of these types of commercial dishwashing machines can be found in U.S. Pat. No. 4,439,242, issued Mar. 27, 1984 to Hadden.

Of course, any dishwasher must thoroughly clean, and sanitize the ware upon which it operates. To this end, an organization called the National Sanitation Foundation (NSF) was formed in the late 1940's. One of its functions is to provide minimum standards for commercial dishwashing machines to assure that ware has been adequately cleansed and sanitized.

While NSF standards are theoretically voluntary, public health and sanitation officials in the United States are believed to rely heavily upon them. A manufacturer is permitted to place an NSF label on the equipment to show that its design, manufacture and operation meet all of the minimum NSF standards for that particular type of equipment. Many sanitation officials will not permit installation or use of commercial dishwashing machines within their jurisdiction unless the machines have NSF labels, indicating that they are "listed" as being recognized by NSF. In effect, NSF standards are so well accepted that very few commercial dishwashing machines are sold in the United States without NSF listing.

A typical dishwasher operates to clean ware by directing pressurized streams of heated water against the ware. Thus, a pumping system is generally provided that directs the water into a spray system having a plurality of nozzles for forming the pressurized streams. The particular construction of the spray system is dependent upon the type of machine, and in the case of a conveyor-type commercial machine, the spray system is disposed above and below the conveyor path. In a typical configuration, one or more fluid conduits extend from a spray manifold across the path in a generally transverse orientation above or below the conveyor.

More than one such manifold is usually provided, with various ones thereof dedicated to washing, rinsing, or the like.

Since most dishwashers recycle water through the spray system (other than rinse water, which is fresh), wash water that has previously been in contact with soiled ware is circulated through the spray system. Although larger soil is typically screened or filtered, some smaller soil particles and other debris can pass through the system, and present at least the potential for accumulation within the spray manifold. This not only represents an unsanitary condition, but can cause plugging of spray nozzles or interference with the water flow, thereby reducing the pressure or amount of water reaching the ware.

This problem has been recognized by, among others, the NSF. In its Standard No. 3 for Commercial Spray Type Dishwashing Machines, NSF has provided in Section 4.12 as follows:

"Spray Arms: Spray arms or similar devices shall be readily removable and easily cleanable, or easily cleanable in place. Spray arms or similar devices shall be designed and constructed to assure their reassembly in proper alignment."

Dishwasher manufacturers have followed this standard in designing and constructing conveyor-type machines. Moreover, many local health regulations specifically require the cleaning of spray arms at predetermined periodic intervals.

Despite the need to remove the spray manifolds for cleaning with relative frequency, such removal and the subsequent reinstallation has been a relatively tedious process. Typically, doorways are provided along the forward side of a conveyor-type machine to give access to the wash and rinse chamber interiors. However, to give such access to the chambers and to other components such as drains, screens and the like, the water supply conduits to the spray manifolds should preferably be placed at the back side of the machine. Accordingly, the connection of a manifold to its supply conduit must also be placed at the back of the machine, where it is almost impossible for the machine operator to reach the typical type of quick-connect/disconnect attachment means. Thus, if the supply is located remote from operator accessability, it is necessary to provide a coupling and uncoupling system which can be operated from a remote position without the use of tools.

One possible solution to this problem is proposed in U.S. Pat. No. 4,257,559, issued Mar. 24, 1981 to Noren. A spray manifold is provided that consists of a single cylindrical tube having a plurality of spray nozzles formed along the tube. At the rear side of the machine, a conical outlet is connected to the water supply conduit, so that the cylindrical manifold is placed over the conical outlet to form a fluid connection. At the front side of the machine, a threaded stud having a cap member attached thereto is engaged with the machine. The cap includes a sealing means, so that when the manifold is placed upon the conical outlet at the rear side of the machine, the cap can be placed on or adjacent to the opposite end of the manifold. Rotation of the cap causes the stud to force the cap into engagement with the manifold, thereby securing it in place and providing a fluid seal at each end. The manifold also includes a pin that cooperates with a plate having a slot attached to the conical outlet. Thus, by engaging the pin with the slot, proper orientation of the manifold is ensured.

While the Noren spray system enables the operator to remove the spray manifold from the forward side of the machine, it possesses several disadvantages in removing and reinstalling the manifolds, e.g. removal and installation of the manifold of Noren requires rotation of the cap to release or secure the manifold. Since the interior of the wash chamber will typically be wet, as well as the operator's hand, adequate gripping of the cap to enable its release or tightening may be quite difficult.

What is needed, therefore, is a spray manifold structure that enables easy removal and reinstallation within a commercial conveyor-type dishwashing machine so that the manifolds can be easily cleaned. Such a construction should enable relatively large manifolds to be manipulated, and should permit removal and installation from the forward side of the machine. At the same time, however, such a structure should not render the manifolds and/or the securing and sealing apparatus unduly complex.

U.S. Pat. No. 4,657,188 discloses a manifold containing multiple spray arms for use in a warewasher wherein the manifold can be removed for cleaning or replacement. The manifold is constructed so that it is connected to the liquid supply conduit by mis-aligning the manifold with the liquid supply conduit and then pivoting the manifold until it becomes properly aligned with the liquid supply conduit. Once aligned, the manifold is secured to the wearwasher by securing a J-shaped rod located at the outer ends of the wash arms, to a latch plate secured to the interior of the warewasher. While the above manifold can be readily removed and replaced without the use of tools, there is a need for a simpler device which not only allows a spray arm such as a rinse arm to be easily secured to a warewasher but which also provides improved liquid-tight reliability.

SUMMARY OF THE INVENTION

In accordance with the present invention, there is provided a quick change rinse arm spray system for use in a wearwasher wherein the spray system comprises a rinse arm which includes first and second ends for sealed engagement with a water supply source; a second end which may be an open end or a closed end; a rinse arm stop located near the first open end which determines both the depth of insertion into a water supply connector and the alignment of the rinse arm with respect to the connector; a plurality of spray nozzles formed along the rinse arm so that water entering the rinse arm under pressure is directed through each of the nozzles and onto the articles being rinsed; and a spring actuated, quick release mechanism for engaging the second end of the rinse arm wherein the spray system provides a sealed system which can be easily and quickly removed for cleaning or replaced without the use of tools and also provides improved water-tight reliability.

Accordingly, it is an object of the present invention to provide a spray system for a wearwasher wherein the quick change spray system has a rinse arm that is quickly and easily removed for cleaning or replacement without the need for tools.

It is another object of the present invention to provide a spray system in which the system is simple and inexpensive to manufacture.

Other objects and advantages of the present invention will be apparent from the following description, the accompanying drawings, and the appended claims.

DETAILED DESCRIPTION OF THE INVENTION

The quick change rinse arm spray system of the invention pertains to wearwashers which are in heavy use on a daily basis wherein the down time to clean or replace the rinse spray arm is critical.

Figure 1:
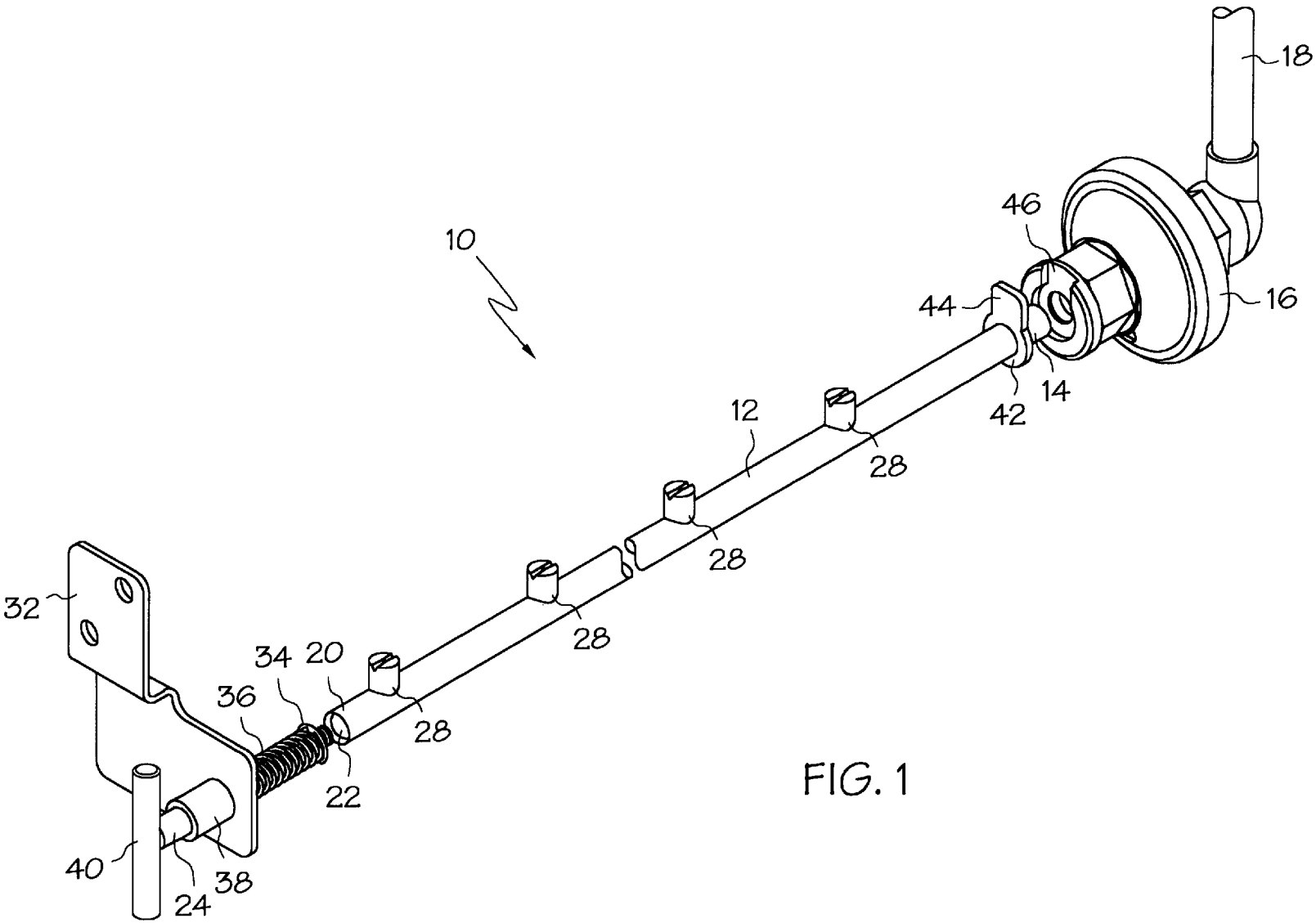
FIG. 1 is a perspective view of the rinse system of the invention showing one end of the rinse arm disengaged from the rinse water supply connector device and the other end disengaged from the actuating mechanism.
Figure 2:
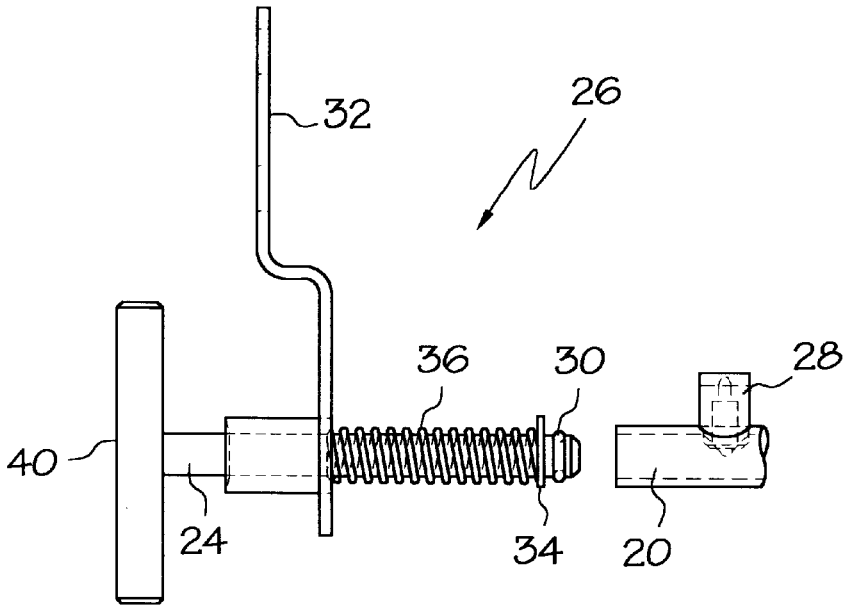
FIG. 2 is a side sectional view of the actuating mechanism.
Figure 3:
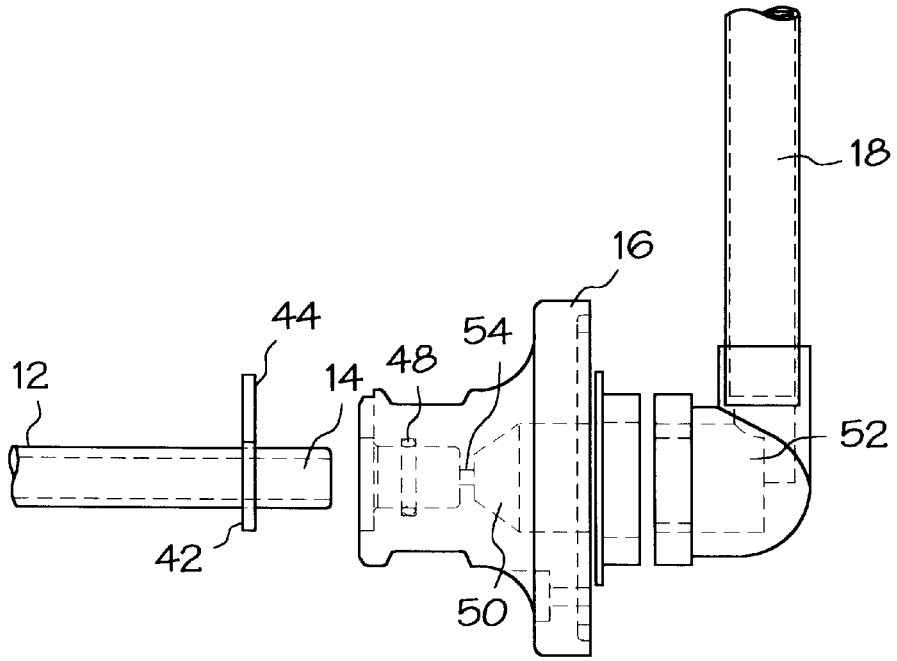
FIG. 3 is a side sectional view of the rinse water supply conduit and connector device.
Figure 4:
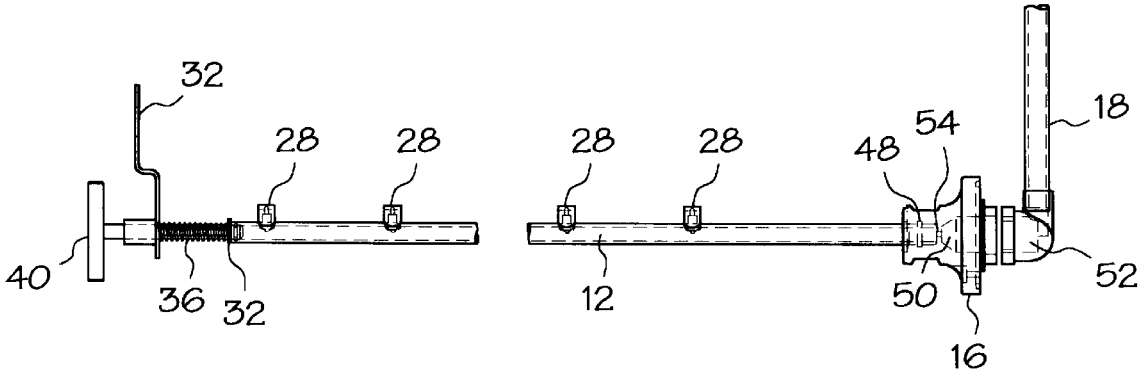
FIG. 4 is a side sectional view of the rinse system showing the rinse arm, the rinse water supply conduit and connector device, and the actuating mechanism.
Figure 5:
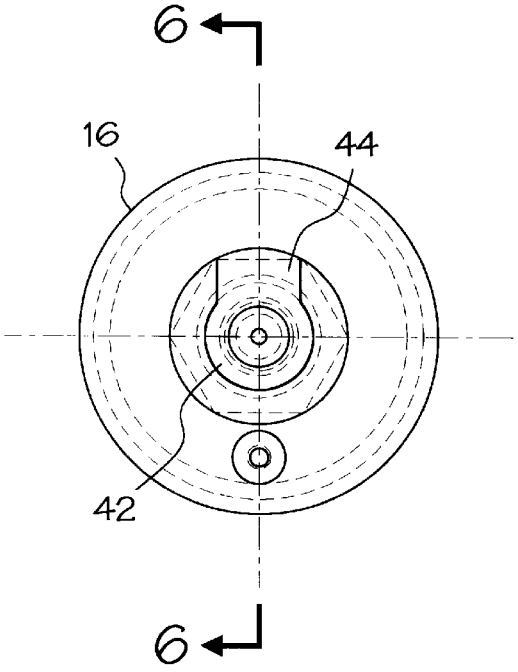
FIG. 5 is a front view of the connector device.
Figure 6:
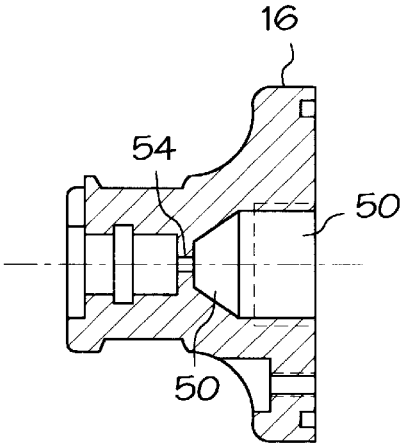
FIG. 6 is a side view of the connector device taken along lines 6—6.

Referring to the drawings, FIG. 1 illustrates the rinse arm spray system 10 comprising a rinse arm 12 which includes a plurality of spray nozzles 28 for spraying hot rinse water onto the articles being rinsed. The rinse arm 12 further includes a first open end 14, near the coupler or connector 16 which couples the water supply conduit 18 to the first open end 14, and a rinse arm stop 42 which stops the rinse arm 12 from extending into the water supply connector 16 beyond a predetermined depth. Typically, the connector 16 contains a reduction device 50 having a first orifice 52 for allowing water to enter the device and a second orifice 54 for allowing water to exit the device 50. The second orifice 54 is smaller in diameter than the first orifice so that the water exiting the device 50 is at a higher pressure than the water entering the device 50. The shape of the rinse arm stop 42 is typically of a shape which prevents the rinse arm 12 from being misaligned, e.g., the rinse arm stop 42 may contain an integral tab 44 which mates with a corresponding notch 46 in the connector 16 so that rotation of the rinse arm 12 is prevented and the arm remains in the proper alignment (as shown in FIG. 1). The rinse arm 12 also includes a second end 20 at the end of the rinse arm 12 opposite the first open end 14. Preferably, the second end 20 is open so that the rinse arm can be easily cleaned; however, it may be closed if desired. If the second end 20 is closed then there is typically a recessed portion 22 in the second end 20 which accepts and securely accommodates rod 24 of the actuating mechanism 26. If the second end 20 is open, then the rod 24 includes an O-ring ring 30 seated in a groove (not shown) around the rod 24 (FIG. 2) to prevent the rinse water from leaking from the system 10 during operation of the rinsing cycle. An actuating mechanism 26 is secured to a rinse chamber (not shown) of the warewasher by bracket 32. Rod 24 extends through the bracket 32 and is connected at one end to an actuating handle 40. The other end of rod 24 is disposed in the second end 20 of the rinse arm. Near the end of the rod 24 which cooperates with the second end 20, there in provide a retaining ring 34 seated in a groove (not shown) in the rod 24. Between the retaining ring 34 and bracket 32, the actuating mechanism 26 is provided with a helical spring 36 which encloses rod 24. On the opposite side of bracket 32, there is a guide tube 38 through which rod 24 extends. As discussed above rod 24 terminates with a handle 40 which mechanically actuates the actuating mechanism 26, or a motor which electronically actuates the actuating mechanism 26. In a preferred aspect of the invention the actuating mechanism 26 is actuated by handle 40, which is illustrated in FIGS. 1, 2 and 4 as a T-handle, but can be any type or shape handle known in the art to actuate rod 24 which connects and disconnects the rinse spray arm 12. For example, the handle 40 may be a pivot-type handle where pressure is applied to a handle which pivots on a pin. The spring 36 provides necessary resistance between the bracket 32 and the retaining ring 34 so that the rod 24 secures the rinse arm 12 until additional cleaning or replacement is required, at which time the handle 40 is simply and easily actuated by applying the necessary pressure on the handle 40 in the direction away from the rinse arm 12 wherein the spring 36 is compressed and the rinse arm 12 is quickly and easily disconnected.

To replace the rinse arm 12, pulling pressure is applied to the handle 40 to compress spring 36 wherein the first open end 14 of the rinse arm 12 is inserted into the connector 16 and rotated until the tab 44 mates with notch 46 while the second end 20 of the rinse arm 12 is aligned with rod 24 of the actuating mechanism 26 and the handle 40 of the actuating mechanism 26 is then released to firmly secure the rinse arm 12 in the proper position.

While the structure of the rinse spray system disclosed herein constitutes a preferred embodiment of the invention, it is to be understood that the invention is not limited to this precise structure, and that changes may be made therein without departing from the scope of the invention which is defined in the appended claim.

What is claimed is:

1. A rinse arm spray system for directing multiple streams of water supplied under pressure from a source of said water, said system comprising:

a water supply conduit for supplying said water;

a rinse arm having an exterior surface, an interior volume, a first open end, and a second end, said arm being releasably connected to said water supply conduit wherein said first open end is in communication with said water supply conduit;

a plurality of spray nozzles spaced apart along the exterior surface of said arm, said nozzles communicating with the interior volume of said arm for providing directed streams of said water supplied to said arm under pressure;

a connector between said water supply conduit and said first open end of said rinse arm including a reduction device having a water-entering orifice and a water-exiting orifice, said water-exiting orifice being smaller than said water-entering orifice whereby water flowing from said connector is at a higher pressure than water flowing into said connector;

an actuator releasably connected to said second end of said rinse arm, said actuator comprising a rod adapted to engage said second end of said rinse arm, a guide tube for supporting said rod, a collar fixed to said rod for receiving a helical spring, wherein said helical spring encircles said rod and biases said rod into engagement with said rinse arm second end when said spring is released and wherein said rod is disengaged from said rinse arm second end when said spring is compressed.

2. The rinse arm spray system of claim 1 further comprising a handle affixed to said rod for engaging and disengaging said rod to and from said rinse arm second end.

3. The rinse arm spray system of claim 1 further comprising an electric motor coupled to said rod for engaging and disengaging said rod to and from said rinse arm second end.

4. A rinse arm spray system for directing multiple streams of water supplied under pressure from a source of said water, said system comprising:

a water supply conduit for supplying said water;

a rinse arm having an exterior surface, an interior volume, a first open end, and a second end, said arm being releasably connected to said water supply conduit wherein said first open end is in communication with said water supply conduit;

a plurality of spray nozzles spaced apart along the exterior surface of said arm, said nozzles communicating with the interior volume of said arm for providing directed streams of said water supplied to said arm under pressure;

an actuator releasably connected to said second end of said rinse arm, said actuator comprising a rod adapted to engage said second end of said rinse arm, a guide tube for supporting said rod, a collar fixed to said rod for receiving a helical spring, and a handle affixed to said rod for engaging and disengaging said rod to and from said rinse arm second end, wherein said helical spring encircles said rod and biases said rod into engagement with said rinse arm second end when said spring is released and wherein said rod is disengaged from said rinse arm second end when said spring is compressed.

5. A rinse arm spray system for directing multiple streams of water supplied under pressure from a source of said water, said system comprising:

a water supply conduit for supplying said water;

a rinse arm having an exterior surface, an interior volume, a first open end, and a second end, said arm being releasably connected to said water supply conduit wherein said first open end is in communication with said water supply conduit;

a plurality of spray nozzles spaced apart along the exterior surface of said arm, said nozzles communicating with the interior volume of said arm for providing directed streams of said water supplied to said arm under pressure;

an actuator releasably connected to said second end of said rinse arm, said actuator comprising a rod adapted to engage said second end of said rinse arm, a guide tube for supporting said rod, a collar fixed to said rod for receiving a helical spring, and an electric motor coupled to said rod for engaging and disengaging said rod to and from said rinse arm second end, wherein said helical spring encircles said rod and biases said rod into engagement with said rinse arm second end when said spring is released and wherein said rod is disengaged from said rinse arm second end when said spring is compressed.

* * * * *